United States Patent [19]

Leonhardt

[11] 4,316,543

[45] Feb. 23, 1982

[54] SIEVING ROLLER CONVEYOR FOR GREEN PELLETS

[75] Inventor: Alexander Leonhardt, Bonn, Fed. Rep. of Germany

[73] Assignee: Dravo Corporation, Pittsburgh, Pa.

[21] Appl. No.: 150,898

[22] Filed: May 19, 1980

[30] Foreign Application Priority Data

May 31, 1979 [DE] Fed. Rep. of Germany ..... 2922174

[51] Int. Cl.[3] ..... B07B 13/05

[52] U.S. Cl. ..... 209/673; 209/627; 198/494

[58] Field of Search ..... 209/667, 668, 673, 627, 209/625, 671, 672, 669, 379, 389, 390; 198/494, 496, 497, 498, 501

[56] References Cited

U.S. PATENT DOCUMENTS 2,988,781 6/1961 Meyer ..... 209/673 X
3,438,491 4/1969 Haley et al. ..... 209/673
3,851,753 12/1974 Lazzarini et al. ..... 198/498
4,102,502 7/1978 Vaploni et al. ..... 209/673 X

FOREIGN PATENT DOCUMENTS 564412 3/1930 Fed. Rep. of Germany ..... 209/673

*Primary Examiner*—Allen N. Knowles
*Attorney, Agent, or Firm*—Parmelee, Miller, Welsh & Kratz

[57] ABSTRACT

This invention relates to a sieving roller conveyor for transporting green pellets and for sieving off fines. The conveyor comprises a series of horizontally disposed rollers which are alternately spaced to provide a cleaning clearance and a sieving clearance. The rollers extend transversely to the direction in which pellets are to be conveyed and are rotatably mounted in a frame and provided with drive mechanism for the rotation of the rollers in the direction in which the pellets are to be conveyed.

8 Claims, 2 Drawing Figures

SIEVING ROLLER CONVEYOR FOR GREEN PELLETS

BACKGROUND OF THE INVENTION

FIELD OF INVENTION

The invention relates to an apparatus for the conveying of green agglomerates, such as pellets, while sieving unwanted materials from the burden.

Ores or intermediate metallurgical products are often pelletized in a moist state. The resulting green pellets, which are generally about 5 to 25 mm in diameter, have a low mechanical strength and for this reason are generally thermally hardened, in most cases on a firing machine. Because green pellets are highly susceptible to mechanical stress, they must be most carefully handled in transit to the firing machine. For this purpose they are conveyed by a seiving roller conveyor, which comprises a series of rollers driven in the direction of conveyance. The clearance between adjacent rollers is smaller than the smallest diameter of the pellets but larger than the particle size of undesired fines, such as broken pellets or abraded fines. The fines fall through these sieving clearances between the rollers so that only pellets having the desired size reach the firing machine (for example German specification DE-PS No. 10 63 811). As the pellets are conveyed on the sieving roller conveyor, the surface of the pellets is roll-formed and the pellets are caused to form a bed of uniform height. Green pellets are sometimes made from ores or concentrates which tend to cake. In that case the rollers of the sieving roller conveyor may become coated with a layer of ore so that the sieving clearances between adjacent rollers become too small for a sifting of the fines and the handling of the pellets may not be as careful as is desired.

It is an object of this invention to provide a sieving roller conveyor which offers a constant sieving clearance for the elimination of fines, broken pellets and the like.

It is another object of this invention to provide a sieving roller conveyor which frees its rollers of buildup of binders and agglomerates which impede the transport and sieving of pellets.

It is yet an object of this invention to reduce maintenance time and costs by reducing the need for manual cleaning of a roller conveyor.

It is still an object of the invention to provide a roller conveyor which can be used in multiple combinations to sort several different sizes of pellets.

SUMMARY OF THE INVENTION

A sieving roller conveyor is provided with the capability of self cleaning its rollers to provide a constant sieving clearance for the elimination of fines, broken pellets and the like from a bed of pellets. The sieving roller conveyor includes a series of longitudinally spaced rollers each of which is journalled for rotation about the longitudinal axis thereof by a suitable drive means. The rollers are preferably arranged in pairs, each of which pairs defines a cleaning clearance there between and the pairs are aligned in a spaced relation which defines a sieving clearance between each adjacent pair. The cleaning clearance is much smaller than the sieving clearance so that each roller of each pair serves as a cleaning roller for the other roller of the same pair. This ensures that the sieving clearance between the trailing roller of a preceding pair and the leading roller of a succeeding pair will be maintained and the leading and trailing rollers of the conveyor will also be cleaned. The cleaning clearance between the rollers of each pair is selected so that the clearance between adjacent pairs of rollers will not be smaller than desired even when material has been deposited on the rollers.

DETAILED DESCRIPTION OF THE INVENTION

Figure 1:
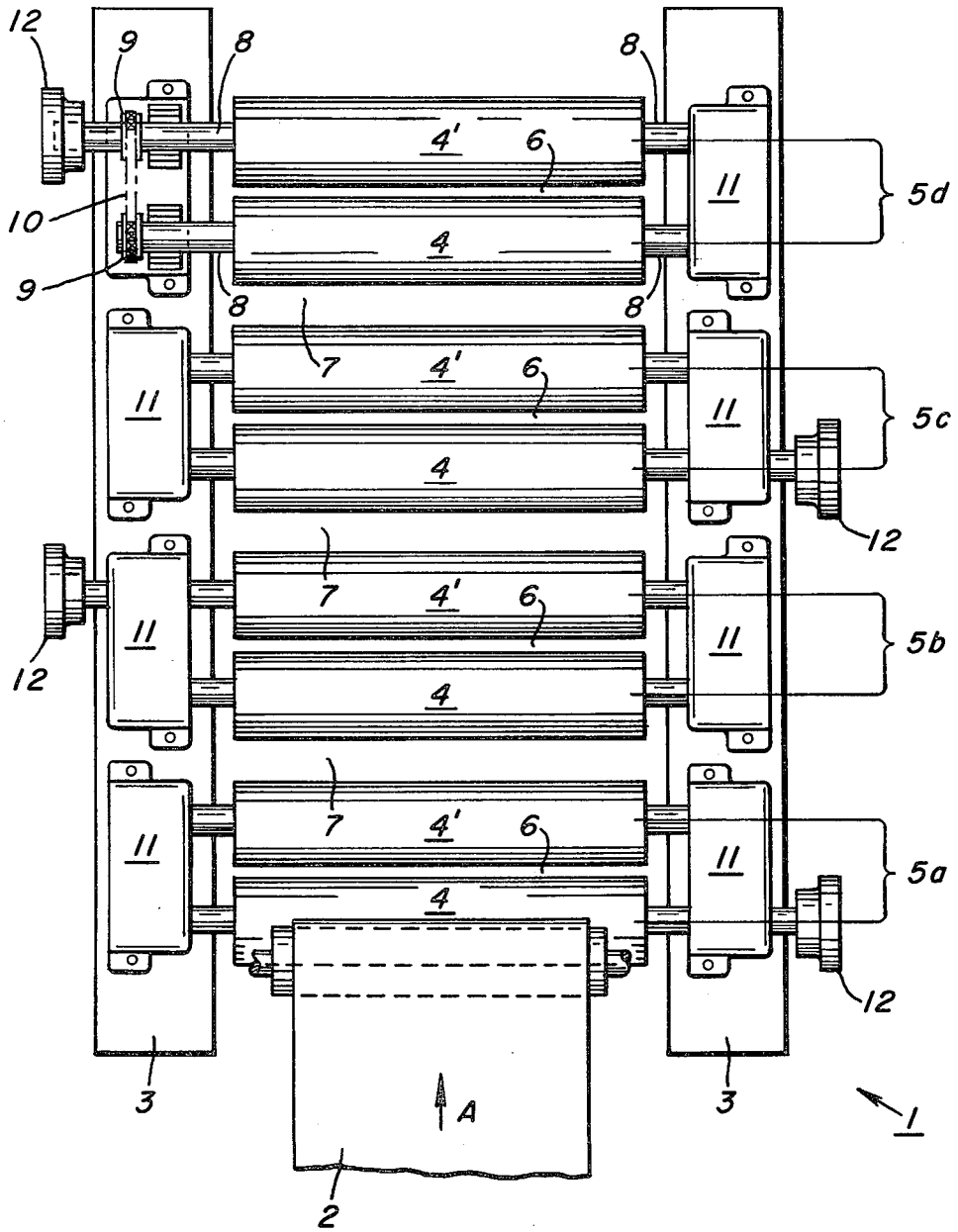
FIG. 1 schematically illustrate a top view of a sieving roller conveyor in accordance with the feature of the invention.

Referring now to FIG. 1, a sieving roller conveyor is generally indicated by the numeral 1. A belted conveyor 2, which charges a burden onto the roller conveyor 1 at its upstream end, revolves in a direction indicated by the arrow A. The roller conveyor 1 consists of frame members 3 onto which a series of rollers 4 and 4' are transversely mounted for rotational movement. In the preferred embodiment the rollers 4 and 4' are mounted in pairs 5*a*, 5*b*, 5*c*, and 5*d* onto the frame 3. The rollers 4' are the downstream or trailing component of each roller pair. The rollers 4 and 4' are longitudinally distanced from one another so as to define a cleaning clearance 6. Any deposits of binder or agglomerate which may build up on the rollers 4 and 4' is limited to a maximum thickness dictated by the cleaning clearance 6. The pairs of rollers 5*a*, 5*b*, 5*c*, and 5*d* are spaced apart to define a sieving clearance 7 which is only as narrow as the smallest diameter pellet that is to be retained on the conveyor.

The rollers 4 and 4' are mounted on shafts 8 where gears 9 are secured at one end thereof. A chain 10 is trained around the gears which are enclosed by the housing 11. A means for driving the rollers is provided by the clutches 12. Each roller may be driven by a separate motor or the rollers of each pair may be driven by a common motor which rotates the rollers in the direction in which the pellets are to be conveyed.

Figure 2:
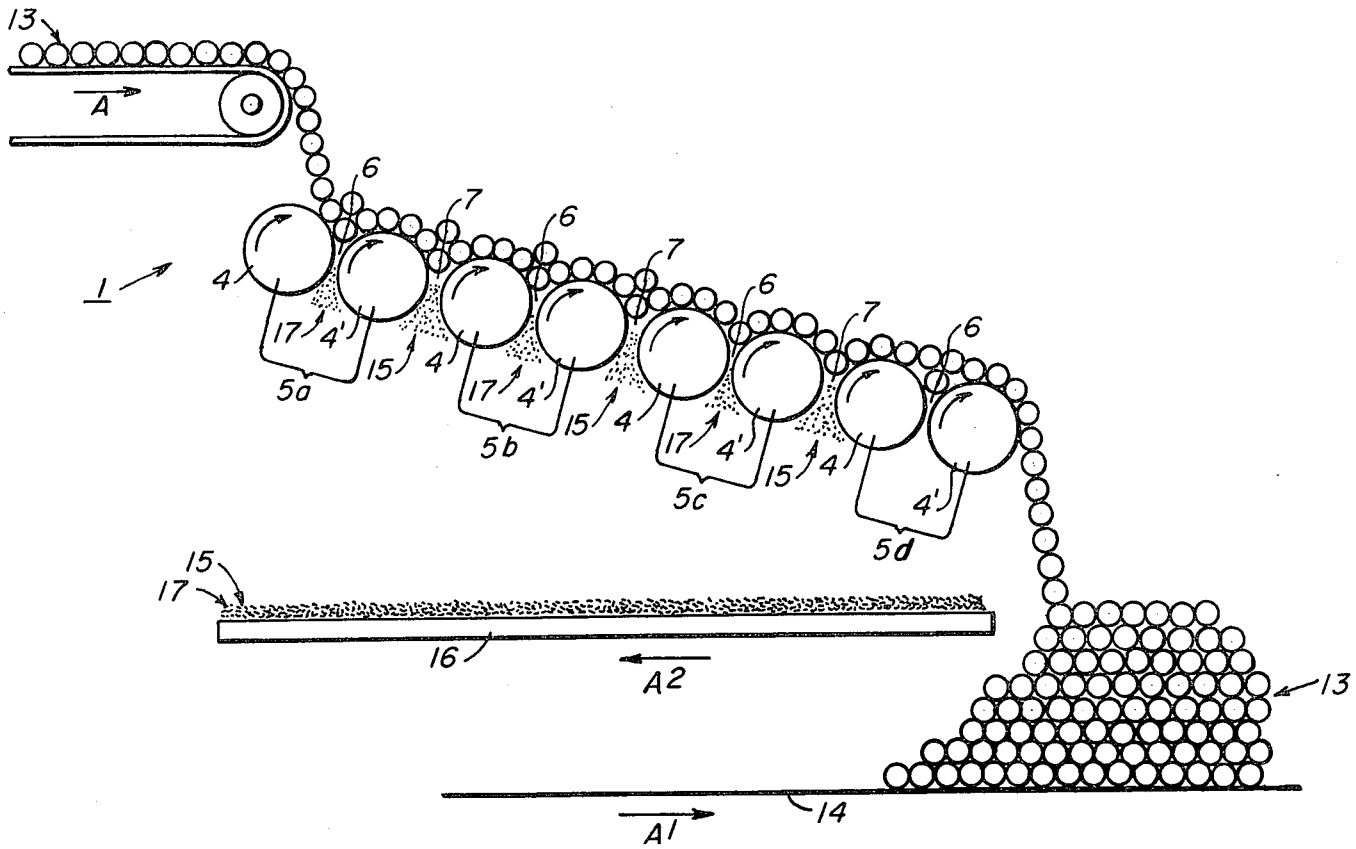
FIG. 2 is a diagrammatic side elevation of the conveyor showing only the rollers, for the sake of clarity.

Considering both FIGS. 1 and 2, the cleaning clearance 6 is much smaller than the sieving clearance 7 so that each roller 4 or 4' of each pair of rollers serves as a cleaning roller for the other roller 4' or 4 of said pair. For example, the leading roller 4 of pair 5*c* cleans and is cleaned by the trailing roller 4' of pair 5*c*. This cleaning action ensures that the sieving clearance 7 between trailing roller 4' of a preceding pair 5*b* and the lead roller 4 of a succeeding pair 5*d* will be maintained. The cleaning clearance between the rollers of each pair is selected so that the clearance between adjacent pairs of rollers will not be smaller than desired even when material has been deposited on the rollers. Preferrably, the sieving clearance is about between 6 and 8 mm, and the cleaning clearance is about between 2 to 3 mm. These clearances ensure a good sieving action and a satisfactory cleaning.

The simplified schematic representation of a roller conveyor 1 in FIG. 2 provides a clear understanding of the cleaning and sieving action of the instant invention. The burden of pellets and fines is charged onto the roller conveyor 1 by belt conveyor 2. The pellets 13 are discharged at the downstream side of the conveyor 1 onto a traveling grate 14 which may be moving in the direction generally indicated by the arrow $A^1$. Fines and parts of the burden which fail to meet the minimum size requirements as established by the cleaning and sieving clearances, indicated generally by 15, fall through the sieving clearances 7 on to a conveyance means 16 for removal and processing.

Binders and agglomerates 17 build up on the surface of each roller and increase the diameter of each roller until the surface deposits of a roller 4 comes into contact with the surface buildup of roller 4'. The rotation of the rollers 4 and 4' of each roller pair provides frictional contact between the deposits on each roller and cleans these deposits from the rollers. This frictionally removed material 17 also falls from cleaning clearances 6, to the conveyance means 16 which may travel in the direction indicated by the arrow $A^2$.

The sieving roller conveyor may be horizontal or slightly inclined in the direction of conveyance. It may be sufficient to provide the sieving roller conveyor sequence of alternating cleaning and sieving clearances only in a single section of the conveyor or in several sections spaced along the length of the conveyor. It is equally feasible to maintain an alternating sieving-cleaning combination along the entire length of the conveyor.

To provide a capacity for the sorting of pellets of more than one size, two sieving rollers can be arranged one over the other. The upper conveyor would be provided with a larger sieving clearance which would pass fines and smaller pellets to the lower conveyor for further sorting in accordance with this invention as described.

The advantages afforded by the invention reside in that even in the handling of green pellets which tend to form deposits on the rollers, the sieving clearances can be maintained constant in a simple manner and a satisfactory sieving action and a careful handling in transit are ensured.

I claim:

1. In a sieving roller conveyor for conveying green pellets and for sieving off fines having a series of horizontal rollers which are spaced apart so that the clearance between adjacent rollers is smaller than the smallest diameter of the pellets to be carried and sieving clearances are defined between certain adjacent rollers, the rollers extending transversely to the direction in which the pellets are to be conveyed and being rotatably connected in a frame provided with means for driving the rollers in the direction in which the pellets are to be conveyed, the improvement wherein:

a portion of said series of rollers are spaced so as to provide sieving clearance, and a further portion of said series are spaced so as to provide cleaning clearance, said cleaning clearance being smaller than said sieving clearance.

2. The improved sieving roller conveyor of claim 1 wherein the cleaning clearance is between 2 to 3 mm.

3. The improved sieving roller conveyor of claim 1 or 2 wherein the sieving clearance is between 6 to 8 mm.

4. The improved sieving roller conveyor of claim 1 wherein each roller is spaced from the adjacent rollers to provide alternate sieving clearances and cleaning clearances along the conveyor.

5. The improved sieving roller conveyor of claim 4 wherein the sieving clearance is between 6 to 8 mm and the cleaning clearance is between 2 to 3 mm.

6. In a sieving roller conveyor for conveying green pellets and for sieving off fines having a series of horizontal rollers which are spaced apart so that the clearance between adjacent rollers is smaller than the smallest diameter of the pellets to be carried and sieving clearances are defined between certain adjacent rollers, the rollers extending transversely to the direction in which the pellets are to be conveyed and being rotatably connected in a frame provided with means for driving the rollers in the direction in which the pellets are to be conveyed, the improvement wherein:

said rollers are arranged in pairs, the rollers of each of said pairs being spaced so as to provide a cleaning clearance, said cleaning clearance being smaller than said sieving clearance, and said pairs are spaced so as to provide a sieving clearance between adjacent pairs.

7. The improved sieving roller conveyor of claim 6 wherein the cleaning clearance is between 2 to 3 mm.

8. The improved sieving roller convey of claim 6 or 7 wherein the sieving clearance is between 6 to 8 mm.

* * * * *